US005694845A

United States Patent [19]

Newman

[11] Patent Number: 5,694,845

[45] Date of Patent: Dec. 9, 1997

[54] SCREEN PRINTING REGISTRATION SYSTEM

[76] Inventor: Garry Newman, 1036 Linden, Glendale, Calif. 91201

[21] Appl. No.: 731,441

[22] Filed: Oct. 15, 1996

[51] Int. Cl.[6] ..... B05C 17/08

[52] U.S. Cl. ..... 101/126; 101/123

[58] Field of Search ..... 101/114, 115, 101/123, 126, 127, 127.1, 128.1, 129, DIG. 36

[56] References Cited

U.S. PATENT DOCUMENTS

| | | | |
|---|---|---|---|
| 4,583,458 | 4/1986 | Beachum . | |
| 4,669,378 | 6/1987 | Lee . | |
| 4,735,139 | 4/1988 | Szarka . | |
| 4,738,909 | 4/1988 | Jennings . | |
| 4,846,058 | 7/1989 | Farris . | |
| 4,911,070 | 3/1990 | Miske et al. | 101/126 |
| 4,938,130 | 7/1990 | Thorpe . | |
| 4,972,773 | 11/1990 | Barlow . | |
| 4,993,166 | 2/1991 | Bradley . | |
| 5,090,313 | 2/1992 | Chapman . | |
| 5,094,160 | 3/1992 | Jennings . | |
| 5,127,321 | 7/1992 | Proffer . | |
| 5,161,460 | 11/1992 | Andersen et al. . | |
| 5,188,026 | 2/1993 | Fuqua et al. . | |
| 5,275,098 | 1/1994 | Larson | 101/123 |
| 5,327,827 | 7/1994 | Richardson . | |
| 5,483,882 | 1/1996 | Jaffa . | |
| 5,503,068 | 4/1996 | Newman . | |
| 5,613,436 | 3/1997 | Taylor | 101/115 |

*Primary Examiner*—Ren Yan

*Attorney, Agent, or Firm*—Charles H. Thomas

[57] ABSTRACT

A screen printing apparatus is provided with an improved registration system to ensure that a printing screen frame descends to a specific, predetermined, precise position relative to a screen printing platen each time it is lowered. The screen frame and the platen are provided with pairs of laterally separated registration elements. The platen may be provided with a pair of laterally separated, registration pins that project upwardly to corresponding registration openings defined in an angle bar that is attached to the distal end of the screen printing frame. Each time the screen printing frame is lowered down into a horizontal disposition directly above the platen, the registration pins enter the openings and ensure accurate, precise, consistent registration of the screen relative to the platen. In a multicolor screen printing machine a plurality of screens are carried by mounting arms that are hinged about horizontal axes to a turntable. Each platen is provided with an identical pair of registration pins at its distal extremity remote from the turntable axis. Each printing screen frame is likewise provided with an identical spaced pair of registration openings. The angle bar in which the openings are defined can be attached to the distal ends of the side rollers in a retensionable frame, as well as across the distal end of an older style, nonadjustable screen printing frame.

9 Claims, 5 Drawing Sheets

SCREEN PRINTING REGISTRATION SYSTEM

BACKGROUND OF THE INVENTION

1. Field of the Invention

The present invention relates to screen printing devices for imparting colors in predetermined patterns through screens to fabrics or other smooth, flat materials positioned therebeneath.

2. Description of the Prior Art

Screen printing has become the most widespread form of printing applied to a wide variety of fabrics and other materials. Such fabrics include upholstery and many different types of garments, as well as other fabric articles. In the conventional practice of screen printing, garments or other fabric articles are positioned on a flat, rigid support known in the trade as a pallet or platen. A screen is then lowered into position directly above the platen using some type of guiding arrangement to ensure precise positioning of the screen relative to the platen therebeneath. Various types of guide mechanisms are employed. For example, printing screens may be mounted on arms extending radially outwardly from a central upright, vertically oriented turret or turntable. Where multiple colors are to be imparted to the fabric the arms bearing the successive screens for different colored inks are successively rotated about a vertical axis into position above stationary platens bearing garments upon which designs are to be printed. In other screen printing machines the platens are advanced by an endless conveyor into position beneath successive screens.

In screen printing a portion of the screen is masked with some ink impenetrable material so that the ink will pass through the screen only at unmasked locations. The mesh of the screen is fine enough and the viscosity of the ink is great enough so that ink will not pass through the screen unless some downward force on the ink is applied.

The system for forcing ink through the screen may be highly automated or it may be manual. In either case ink is discharged onto the screen and a squeegee operated by manual, pneumatic, hydraulic, or electrical power is passed across the screen in contact therewith, pushing the discharged quantity of ink in front of it. A portion of the ink will pass through the mesh openings in the screen and drop onto the fabric therebeneath. As the squeegee returns to its original position, it typically undergoes a second, return pass across the screen, thereby forcing more ink through the screen and onto the garment in the desired pattern. In other cases the squeegee is lifted from the screen before returning to its starting position.

In manual screen printing operations a printing screen of the type described is positioned directly above a fabric to be printed that is positioned on a flat platen by means of some guide mechanism. The guide mechanism may take the form of a mounting arm carrying the screen and mounted for rotation about a horizontal axis. The mounting arm carrying the screen may be rotated vertically upwardly so as to provide clearance for positioning the fabric on the platen, and then lowered vertically downwardly to a position directly above the platen for the screen printing operation.

To print a design on a fabric that includes several colors a separate screen is provided to print each color. In conventional screen print systems a garment is positioned upon a flat board, sometimes called a platen which is held in an orientation extending outwardly from a base in a screen printing machine. A printing screen, which serves as a mask, is held in the grip of a clamp mounted on an arm rotatable about a horizontal axis. Very typically, in printing multiple colors on a garment several screens, each devoted to a specific color, are mounted on separate arms which are in turn are each rotatable about separate hinge mounts located atop a turntable or carousel at specified, angular increments of separation from each other. The arms are all carried on the carousel which is rotated atop the base. Once one color is printed on the garment through a screen, the screen is raised, the carousel is rotated, and the next screen for a different color is brought into position angularly aligned with the platen. The screen is then rotated down directly above the platen and the next color is printed.

For example, to print a design having four different colors, a turntable having at least four arms must be employed. The arms are typically located ninety degrees apart from each other on the upper surface of the turntable. Platens upon which the garments are to be printed are secured to the base at fixed locations ninety degrees apart with respect to the axis of the turntable. The garments to be printed are first stretched on the platens. Separate screens for each color to be printed are attached to the ends of the mounting arms remote from the turntable and secured to the mounting arms, typically by means of clamps. At each platen position an arm is rotated downwardly, thereby bringing the screen into registration with the garment directly above the platen.

Ink is then pressed through the screen using a squeegee. The ink is thereby imprinted at specific locations on the garment as determined by the pattern of the screen. After imprinting a color on each garment at each color station, the screens are raised, the turntable is rotated ninety degrees, and the next screen is brought into registration to imprint the color associated with that screen onto the garment. Each screen has a different pattern so that the ink is pressed through each of the screens at complementary locations on the garment.

Ideally, after all of the screens of the turntable have been sequentially brought into registration with a garment, each of the colors will be imprinted on the garment at specific locations that are often contiguous to each other. The several colors thereby form a complete design. However, if there is any misalignment in positioning any one of the screens atop the garment during the printing process, the resulting design will be flawed. That is, colors may be imprinted one atop another, and gaps may be left between colors where they should not appear.

OBJECT OF THE INVENTION

One problem with conventional screen printing machines is the difficulty in creating precise alignment of the screen above each platen with each successive printing step. If a screen is not properly aligned, the printing of the color through that screen will not match up properly with the patterns of the other colors printed on the garment. The potential for misalignment is aggravated at the portion of the garment furthest from the axis of rotation of the screen mounting arm since the distal end of the screen resides a considerable distance from the axis of rotation of the mounting arm carrying the screen. As a consequence, even a very small angle of misalignment in a horizontal plane produces a considerable error in the location of printing, especially near the portion of the garment most remote from the carousel hub.

According to the present invention, each screen and each platen are provided with interacting registration elements to ensure proper registration of the screen over the platen. In one embodiment a linear angle bar having a right-angle cross section is attached to the end of the frame in which the screen is mounted. One leg of the angle bar is attached to the transverse, distal end of the screen frame, while the other leg of the angle bar has a pair of positioning apertures defined therethrough. Each platen is equipped with a pair of short, upstanding positioning posts or pins that are separated from each other the same distance as the apertures in the angle bar, and which are located at the same distance from the axis of mounting arm rotation as the apertures in the angle bar.

After the hub or carousel is routed about the central vertical axis of the printing machine, the screen mounting arm is routed downwardly about its horizontal axis. As the screen approaches the platen, the positioning pins on the platen enter the positioning apertures in the angle bar attached to the distal end of the screen. Precise alignment of the screen above the garment on the platen is thereby assured.

In some screen printing systems retensionable screens are configured to allow the material of the screen to be laterally and longitudinally stretched and moved in translation. That is, instead of being mounted in a fixed frame, the lateral edges of the screen are wound about side-stretching rollers that extend generally radially outwardly from the mounting arm axis. Also, the distal end of the screen is likewise wound about a transverse, distal, end-stretching roller that resides at a known distance from the axis of rotation of the mounting arm.

In such systems the principal of operation of the screen printing registration system of the invention is the same, although the connections of the transverse angle piece to the screen are slightly different. That is, since there is no fixed distal end to the screen, the angle bar is attached at its opposite ends to a pair of L-shaped, distal, corner brackets. The radially oriented legs of these brackets carry the transverse, distal, end-stretching roller, while the laterally extending legs of the distal, corner brackets carry the ends of the laterally spaced, side-stretching rollers. One of the ends of the angle piece having the positioning apertures thereon is secured to one of the brackets by a pair of screws that pass through circular mounting apertures in the mounting leg of the angle piece. At the opposite end of the angle piece a similar screw is utilized, but passes through a laterally elongated mounting slot, rather than a circular aperture, to accommodate variances in the distance of separation between the rollers among different retensioning screens.

In one broad aspect the present invention may be considered to be an improvement is a screen printing apparatus employing a horizontally disposed platen for supporting material to be imprinted, a printing screen frame, a frame mounting arm having opposing ends and which holds the screen frame at one of the ends of the arm. The arm is hinged for rotation about a horizontal axis at the other of its ends so as to alternatively carry the screen frame downwardly to a lowered position in which it resides in a horizontal disposition directly above the platen and to carry the screen frame upwardly to a raised position removed from the platen. The screen frame and the platen thereby both have proximal ends located closest to the horizontal axis and distal ends located further from the horizontal axis than their proximal ends.

The improvement of the invention is comprised of a first pair of laterally spaced registration elements positioned at fixed locations on the distal end of the platen and separated from each other by a predetermined, fixed, lateral, registration element separation distance. The first pair of registration elements are spaced from the horizontal axis a predetermined, fixed, radial, registration element placement distance. The improvement is further comprised of a second pair of laterally spaced registration elements at fixed locations on the distal end of the screen frame. These registration elements in the second pair are also separated from each other by the predetermined, fixed, lateral, registration element separation distance. Both of the registration elements in the second pair are spaced from the horizontal axis by the predetermined, fixed, radial, registration element placement distance. The first and second pairs of registration elements engage each other to ensure consistent alignment of the screen frame above the platen when the screen frame is in the lowered position.

While the interacting pairs of registration elements may take different forms, preferably the first pair of registration elements is formed as a pair of pins oriented perpendicular to the platen and a rigid angle piece extends transversely across the distal end of the screen frame. The rigid angle piece has a first leg secured to the distal end of the printing screen frame and a second leg extending radially from the first leg. The second pair of registration elements is preferably comprised of a pair of apertures extending through the second leg of the angle piece. In this way the pins at the distal end of the platen will enter the pair of apertures in the rigid angle piece as the frame is moved to its lowered position, thereby ensuring precise, consistent alignment of the screen frame relative to the platen each and every time that a screen frame is lowered atop the platen.

With use, the joints of a printing screen frame may loosen somewhat, so that the frame tends to rack or twist very slightly from its original rectangular configuration to a parallelogram shape. While this departure from precise quadrature may not be readily apparent to a person printing garments using the screen frame, even a very minute irregularity in this regard will result in a flawed design on the garment. As a consequence, the registration elements in each pair should not be positioned too close together. The further they are separated from each other, the more effective they will be in ensuring that a screen frame has an exact rectangular configuration when it is brought into its lowered position. Preferably, the lateral, registration element separation distance is at least about four inches.

It is also important for the registration elements to be located as far as possible from the axis of rotation of the screen mounting arm. This is because any error in alignment of the screen frame relative to the platen increases with distance from the mounting arm axis. The platen is preferably comprised of a broad body and is formed with a neck considerably narrower than the body and which projects radially from the body. Preferably the neck is at least about five inches long and forms the distal end of the platen.

In another broad aspect the invention may be considered to be a screen printing device comprising a base, a platen, a screen mounting arm, a mounting arm axle, a screen frame, and first and second pairs of registration elements respectively fixed at permanent locations on the distal ends of the platen and the screen frame. The platen is flat and is secured to the base in a horizontal disposition. The platen has a proximal end closest to the base and a distal end furthest from the base. The screen mounting arm has a hinged end and a free end. The axle joins the hinged end of the screen mounting arm to the base for rotation about a horizontal axis. The screen mounting arm is thereby rotatable relative to the base in a vertical plane passing through the platen.

The screen frame has a proximal end held by the free end of the mounting arm and a distal end located remote from the axle. Rotation of the mounting arm alternatively carries the screen frame into a lowered position in which the screen frame is horizontally oriented and disposed directly above the platen, and a raised position removed from the platen. The registration elements of the first pair of registration elements are fixed at permanent locations on the distal end of the platen and are separated from each other by a predetermined, fixed, lateral, registration element separation distance. The elements of the second pair of registration elements are fixed at permanent locations on the distal end of the screen frame also at the same fixed, lateral, registration element separation distance. The first and second pairs of registration elements are engageable with each other when the screen frame is in the lowered position. This ensures consistent alignment of the screen frame in the lowered position relative to the platen.

One of the greatest advantages of the present invention is its adaptability for us with different types of screen printing frame arrangements. In particular, the frame registration system of the invention may be readily utilized with screen frames comprised of retensioning rollers that are secured together with distal, end corner connectors.

In a conventional, retensionable screen frame, the frame is provided with a pair of parallel, side-stretching rollers and at least a distal, end-stretching roller oriented perpendicular to the side rollers. The side-stretching rollers are joined to the distal, end-stretching roller by distal corner connectors. The stretching rollers allow the screen to be stretched so as to eliminate any sagging therein that may occur with use. Also, the stretching rollers allow the pattern on any particular screen to be moved in translation and adjusted in position relative to the platen, both laterally and longitudinally.

Screen printers are turning more and more to screen frames employing retensioning rollers. However, despite their advantages in ability to position a printing pattern within the screen frame, screens with retensioning rollers suffer from the same problems with inconsistent positioning relative to the platens with which they are use, just like the older style, wooden frames with fixed sides.

The present invention is readily adaptable for use with screen frames with retensioning rollers. In such devices the side rollers are joined to the distal end roller by corner connectors that allow the shafts of the lateral side rollers and the transverse end roller to be secured in mutually perpendicular alignment relative to each other. The present invention may be utilized with such systems by replacing the conventional corner connectors of retensionable screen frames with distal, corner-connecting angles. One of the pairs of registration elements is formed in one leg of a rigid, transversely extending angle piece that is secured at its ends to the corner-connecting angles. The angle piece is located radially beyond the distal, tensioning roller, considered with respect to the axis of the screen mounting arm rotation.

The invention may be described with greater clarity and particularity with reference to the accompanying drawings.

DESCRIPTION OF THE EMBODIMENTS

Figure 1:
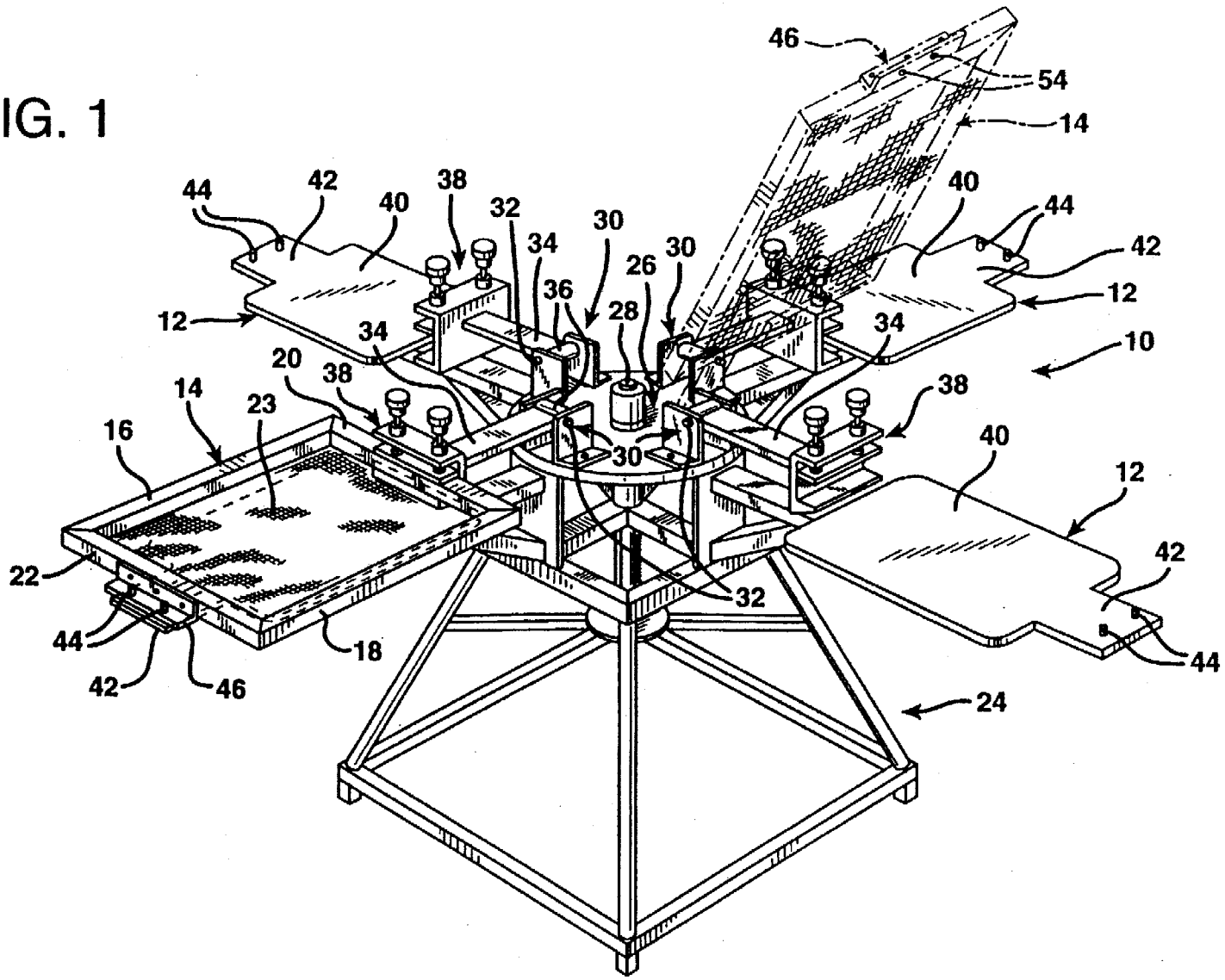
FIG. 1 is a perspective view of a manual, multicolor screen printing machine employing the screen printing apparatus of the present invention.

FIG. 1 illustrates a four station, manual, screen printing machine 10 designed for use to print designs on garments mounted on platens 12 through a plurality of printing screens 14 having rectangular, wooden sides and ends. Each of the screen flames 14 is of a conventional, older style having fixed, linear, mutually parallel side members 16 and 18, and fixed, linear, mutually parallel end members 20 and 22 oriented perpendicular to the side members 16 and 18. The opposing, longitudinal, side members 16 and 18 and the transverse end members 20 and 22 are rigidly secured to each other at their ends so as to form the corners of a rectangular structure. A screen mesh 23 with a particular pattern for printing thereon is stretched across the frame members 16, 18, 20, and 22 of each printing screen frame 14 and is permanently and rigidly secured thereto. The pattern on the screen mesh 23 defines the locations through which ink may pass through the mesh 23 for printing on a garment positioned on a platen 12 located therebeneath.

The printing machine 10 employs a base 24 formed of metal frame members that support a turntable 26 that is rotatable relative to the base 24 about a central, vertical turntable axle 28.

The platens 12 are rigidly secured relative to the base 24 by conventional mounting assemblies that hold the platens 12 in a flat, horizontally disposed orientation, extending radially outwardly from the axle 28. In the four station printing machine depicted in FIG. 1, the four platens 12 are angularly displaced from each other at ninety degree intervals relative to the vertical, turntable axle 28.

Atop the turntable 26 there are four conventional hinge assemblies 30 angularly displaced from each other at ninety-degree intervals. Each hinge assembly 30 includes a pair of upwardly projecting mounting brackets between which a horizontally disposed mourning arm axle 32 extends.

The printing machine 10 also employs four screen mounting arms 34, each having a hinged end 36 and a free end that terminates in a frame mounting clamp 38. Each frame mounting clamp 38 is a conventional structure that defines a radially outwardly facing channel oriented parallel to the axle 32 at the opposite, hinged end of the mourning arm 34, and a pair of thumb screws that may be tightened to engage one of the transverse end members of the screen frame 14.

In the operation of the machine 10 the screen mounting arms 34 are sequentially aligned with each of the platens 12 so that the screen mounting arms 34 are rotatable relative to the base 24 in vertical planes. Each mourning arm 34 is rotatable relative to the base 24 in a vertical plane passing through the platen 12 with which is it angularly aligned during each priming step.

In the embodiment of the invention illustrated in FIG. 1, the transverse end member 20 of each priming screen frame 14 is located closest to the axle 32 of an associated hinge assembly 30 and mounting arm 34 and may therefore be considered to define the proximal end of the screen frame 14. The proximal end member 20 of each screen frame 14 is rigidly secured to an associated screen mounting arm 34 by the thumb screws of the clamp 38 at the free end of the mounting arm 34 which holds the screen frame 14 firmly in the clamp channel. The proximal end member 20 is thereby held parallel to its associated hinge axle 32. The opposite transverse screen frame member 22 is therefore also parallel to its associated hinge axle 32 and is held radially outwardly from both its associated hinge axle 32 and the turntable axis 28. The screen frame end member 22 may therefore be considered to form the opposite, distal end of the screen frame 14.

Each platen 12 has a proximal end 40 formed as a broad, expansive body of generally rectangular configuration and a distal end 42 formed as a neck that is narrower than the body 40 and extends from the body 40 radially outwardly, relative to the turntable axis 28. Preferably, the neck 42 extends radially from the body 40 a distance of at least about five inches and in some cases may extend nine inches from the body 40.

The registration system of the invention includes first and second pairs of registration elements at each printing station. The first pair of registration elements is formed by a pair of pins 44 that are located at the distal end 42 of the platen 12 and project perpendicularly upwardly from the plane of the flat, horizontal structure of the platen 12. The registration pins 44 are of uniform, cylindrical cross section throughout and are mutually parallel to each other. The pins 44 extending upwardly from each platen 12 are located at least about four inches apart, and are preferably positioned about 4.25 inches apart in the embodiment illustrated.

The body 40 of each platen 12 is seventeen inches wide which is a standard in the industry. The neck 42, however, may be constructed in a long or short version. For example, in one embodiment the neck 42 extends five inches beyond the shoulders of the platen body 40 and the registration pins 44 are located one inch in from the transverse, distal edge of the neck 42. In another embodiment of the invention the neck 42 may extend a distance of nine inches radially outwardly beyond the shoulders of the platen body 40. The neck 42 is typically about 5.50 inches in transverse width.

The distance between the upwardly projecting pins 44 at the distal end 42 of each platen 12 may be considered to be a fixed, lateral, registration element separation distance. The registration pins 44 on each platen 12 are aligned with each other along a straight line that is parallel to the axle 32 of the mounting arm 34 aligned with the printing station at which the platen 12 is located. The distance of the registration pins 44 from the axle 32 at that printing station may be considered to be a predetermined, fixed, radial, registration element placement distance.

Figure 2:
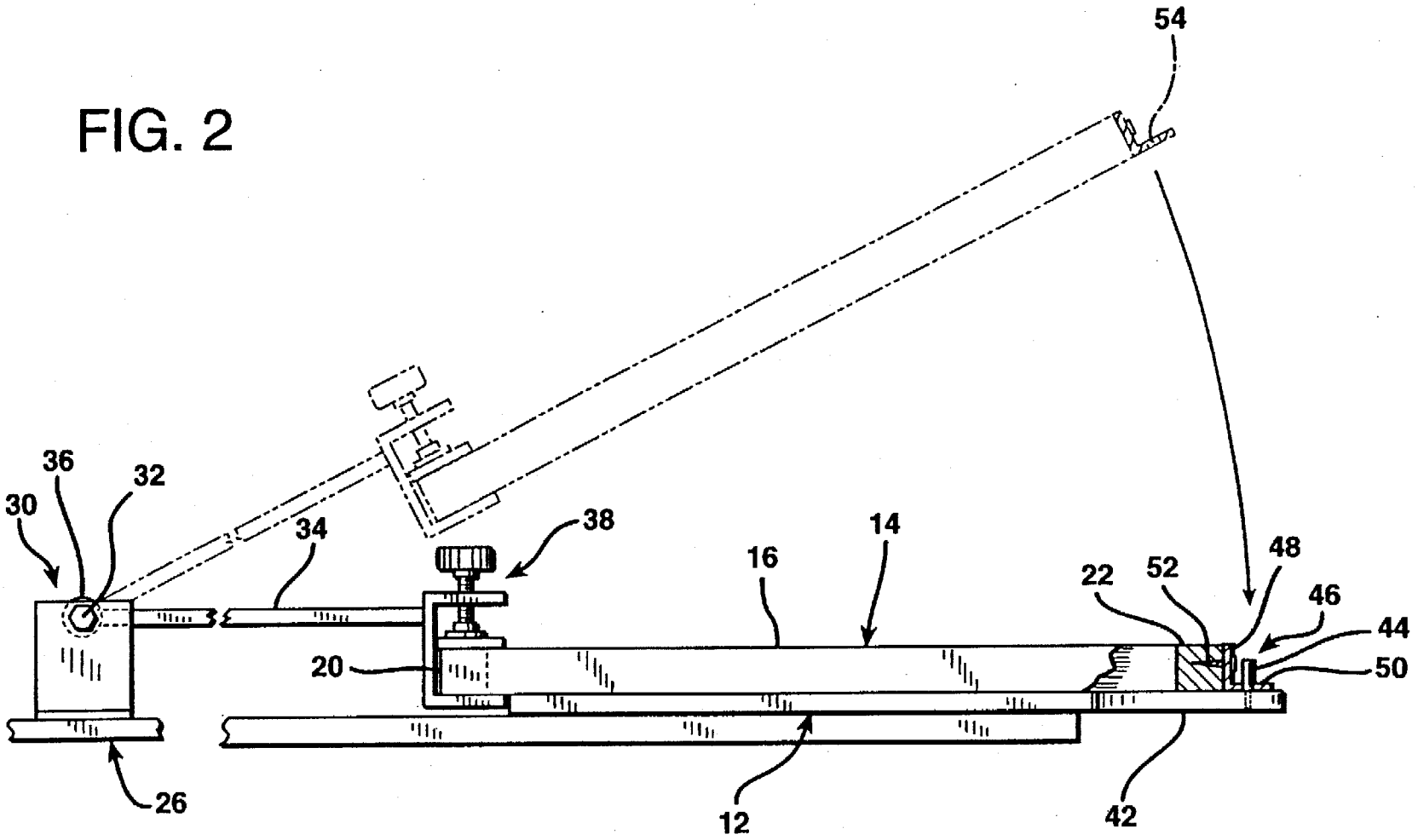
FIG. 2 is a side elevational view, partially broken away, illustrating one of the printing stations of the screen printing apparatus employed in the machine of FIG. 1.
Figure 3:
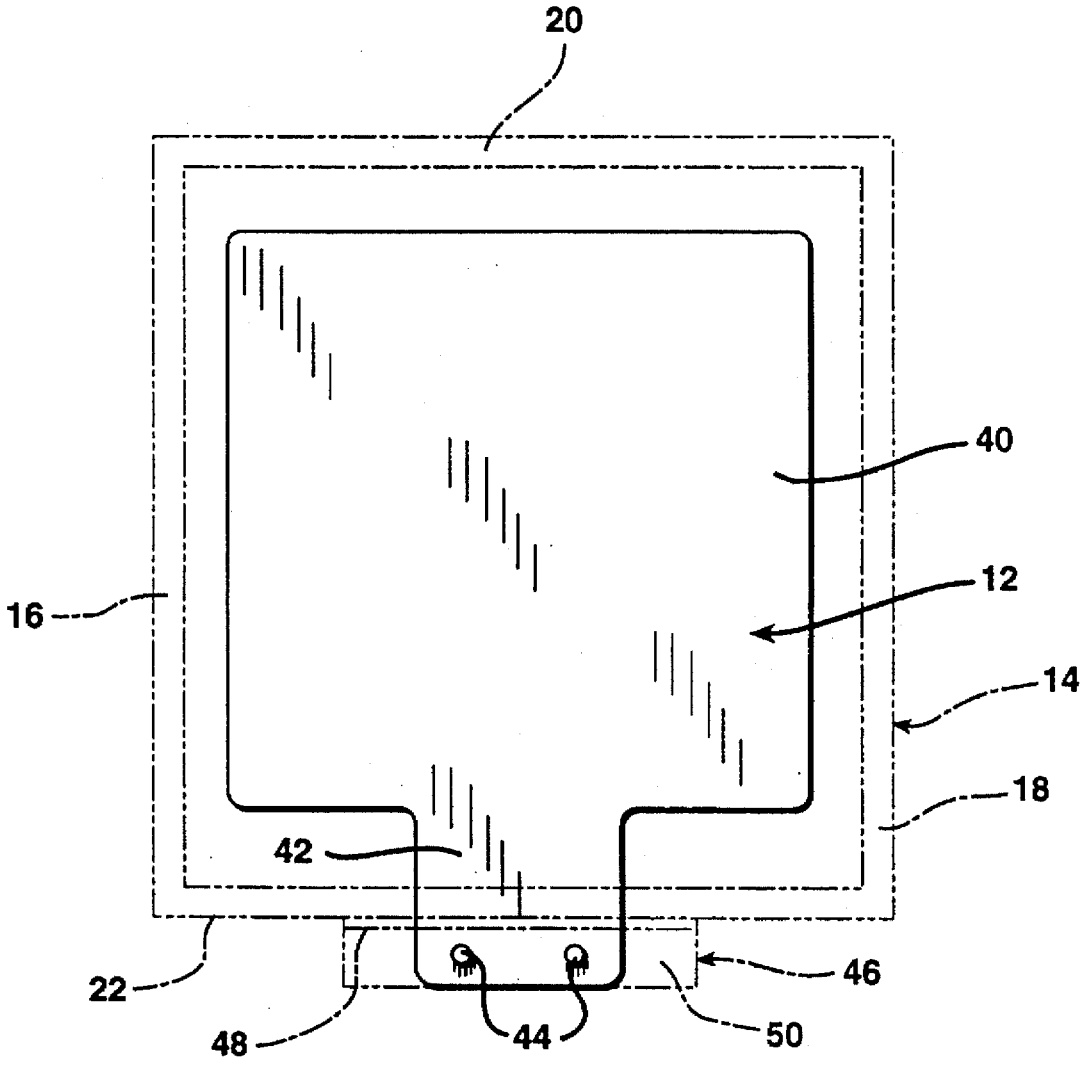
FIG. 3 is a top plan view of a portion of the screen printing station of FIG. 2.

Each screen frame 14 is provided with a rigid, metal angle bar 46 that is transversely oriented relative to the mounting arm 34, and parallel to the axle 32 associated therewith, at the distal end 22 of each screen frame 14. One of the angle bars 46 is best illustrated in FIGS. 2 and 3. Each rigid angle bar 46 is formed of angle iron stock one-eighth of an inch in thickness and is preferably about seven inches long and has a first leg 48 secured to the distal end 22 of an associated screen frame 14 and a second leg 50 extending radially from the first leg 48. Each of the angle bar legs 48 and 50 is preferably about 1.25 inches wide. The first leg 48 of each of the angle bars 46 is secured to the distal end member 22 of its associated screen frame 14 by three wood screws 52 that extend into the transverse, distal end member 22 through holes drilled through the leg 48 of the angle bar 46 near the ends and at the center thereof.

In the other leg 50 of each rigid angle bar 46 there are a pair of apertures 54 that extend completely through the structure of the angle leg 50. The second pair of laterally spaced, registration elements is formed by the two apertures 54 defined in the radially projecting leg 50 of the angle bar 46 at the distal end 22 of each screen frame 14. The apertures 54 in each angle piece 46 are separated from each other by the same predetermined, fixed, lateral, registration element separation distance as the registration pins 44 in each pair of pins in each platen 12. Likewise, the registration apertures 54 are also located at the same predetermined, fixed, radial, registration element placement distance from the axis of their associated axle 32 as the registration pins 44.

As is evident in FIGS. 1, 2, and 3, the pins 44 on the platens 12 that form the first pair of registration elements are engageable with the registration apertures 54 of an angle bar 46 at the distal end 22 of each screen frame 14 as that frame is brought into angular alignment with the platen 12 bearing the registration pins 44. Each mounting arm 34 is rotatable relative to its associated hinge assembly 30 so as to alternatively carry the screen frame 14 clamped to it by means of the clamp assembly 38 downwardly into a lowered position at which it resides in a horizontal disposition directly above the platen 12, as illustrated in solid lines in FIGS. 1 and 2. In this position the screen frame 14 resides directly above the angularly aligned platen 12 therebeneath. Alternatively, the screen frame mounting arms 32 are rotatable upwardly to raised positions removed from the platens 12, as illustrated in phantom in FIGS. 1 and 2.

As the mounting arms 34 bring the screen frames 14 to their lowered position, any misalignment that might otherwise occur due to tolerances or play between the ends 36 of the mounting arms 34 and the hinged mounting bracket assembly 30 is corrected as the registration pins 44 enter the registration apertures 54. Likewise, as the registration pins 44 enter the registration apertures 54, precise, transverse alignment of the distal end member 22 of the screen frame 14 parallel to the axle 32 with which it is associated is assured. This corrects for any departure from precise quadrature that may have occurred in the screen frame 14 due to loosening of the corner connection joints between the frame member 16, 18, 20, and 22.

By providing the printing machine 10 with fixed pairs of laterally spaced registration elements located a predetermined, fixed, lateral, registration element separation distance from each other and a predetermined, fixed, radial, registration element placement distance from the axle 32 of an aligned mounting arm 34, precise, consistent, repeatable alignment of each screen frame 14 above each platen 12 is assured. As a consequence, and unlike prior registration systems, each pattern of each screen 23 is reproduced precisely at the same position relative to the platen 12 therebeneath onto a garment mounted on the body 40 of the platen 12.

Figure 4:
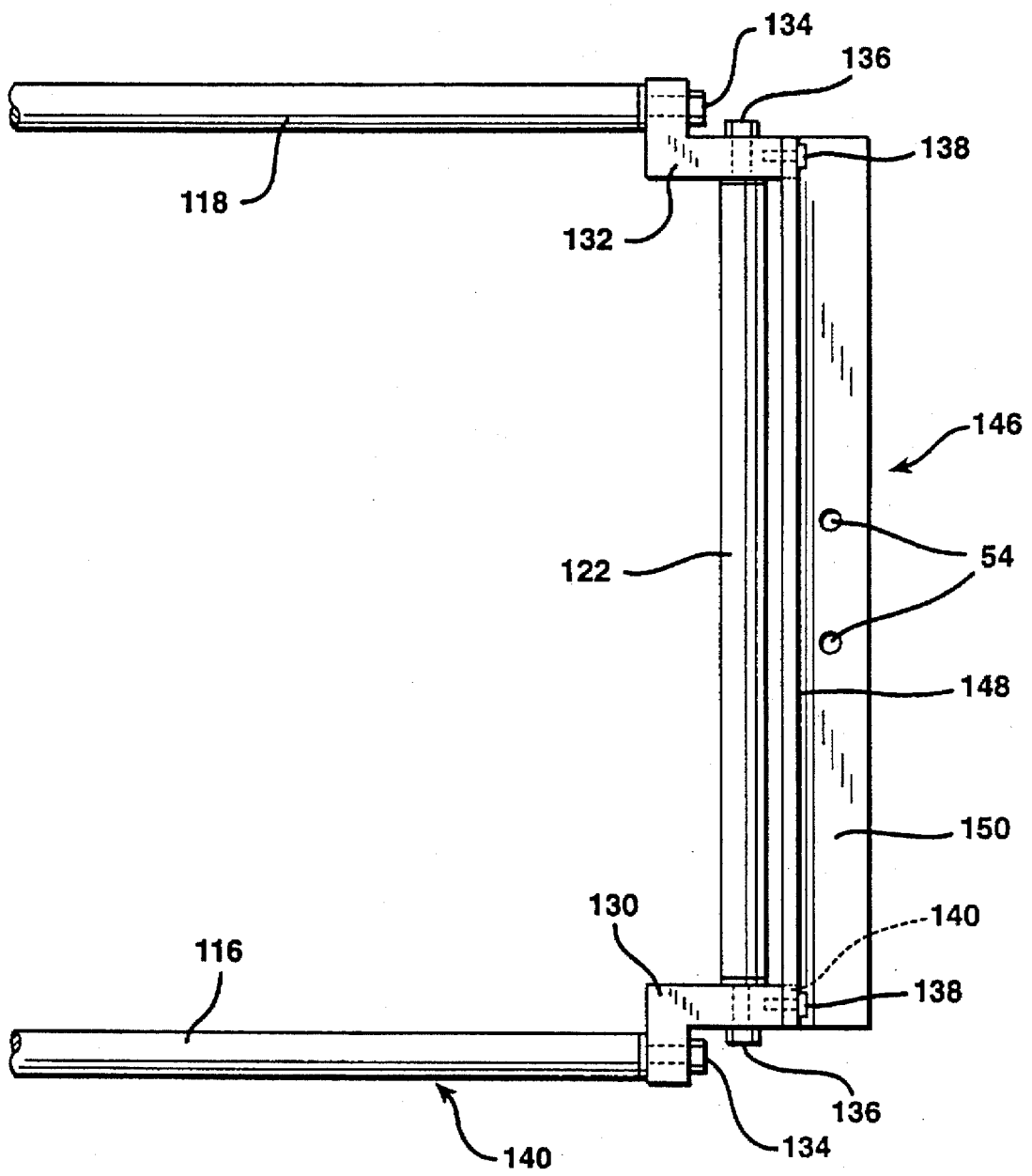
FIG. 4 is a top plan view illustrating a modified form of a printing station of the screen printing apparatus of the invention as adapted for use with a retensionable screen printing frame.
Figure 5:
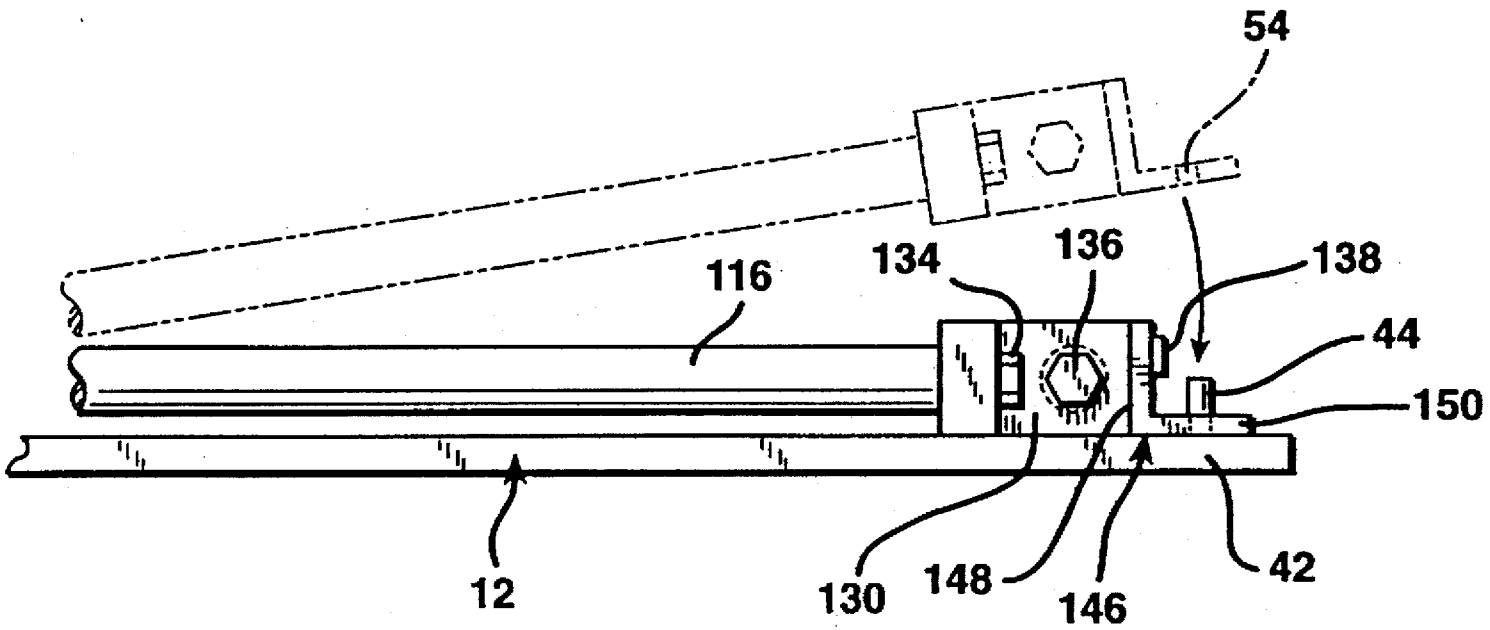
FIG. 5 is a side elevational view of the embodiment of FIG. 4.

While the embodiment depicted in FIGS. 1 through 3 shows the registration system of the invention as employed with older style, wooden-sided screen printing frames 14, the invention is readily adaptable for use with modern retensionable screen frames 140 of the type depicted in FIGS. 4 and 5. In this embodiment the screen 140 is formed with a pair of parallel, side-stretching rollers 116 and 118 and at least a distal, end-stretching roller 122 located at the distal end of the screen frame 140 and joined in perpendicular alignment to the side rollers 116 and 118 by corner connectors.

In the embodiment of the invention illustrated in FIGS. 4 and 5, the corner connectors that are conventionally employed in attaching the side-tensioning rollers 116 and 118 to the distal, end roller 122 are replaced with distal, corner-connecting angles 130 and 132 which respectively form left and right corner-connecting angles as viewed from the perspective of the screen printing machine operator. The transverse legs of the corner-connecting angles 130 and 132 are secured to the longitudinal, side-tensioning rollers 116 and 118 by nuts 134 engaged on the ends of the side-roller shafts. Each of the transverse legs of the angle connectors 130 and 132 is preferable about 1.75 inches in length. The shafts of the side-tensioning rollers 116 and 118 pass through apertures in the transverse legs of the corner-connecting angles 130 and 132.

The opposing, radially extending legs of the corner-connecting angles 130 and 132 are preferable about 2.5 inches in length and include apertures therethrough for receiving the ends of the shaft of the distal, end-tensioning roller 122. Nuts 136 are engaged on the threaded ends of the shaft of the distal, end-tensioning roller 122. While the nuts 134 and 136 may be loosened to allow retensioning 23 (o screen mesh 23 (omitted from FIG. 4), the nuts 134 and 136 are always tightened once the screen mesh has been properly positioned relative to the platen 12 located therebeneath.

Each of the radially extending legs of the distal, corner-connecting angles 130 and 132 includes internally tapped openings adapted to receive the threaded shanks of bolts 138. Each tensioning screen frame 140 is provided with a transverse angle bar 146 that is of the same cross-sectional configuration as the angle bar 46 shown in the embodiment of FIGS. 1–3, but which extends across the entire width of the distal end of the retensionable screen frame 140.

The angle bar 146 is provided with upper and lower bolt holes at one of its ends to receive upper and lower bolts 138 that extend into corresponding upper and lower tapped openings in the corner-connecting angle 130. At its opposite end the angle bar 146 is provided with a transverse slot that is parallel to the end-tensioning roller 122 to accommodate a single bolt 138 that extends into an aligned, internally tapped opening in the radially extending leg of the corner-connecting angle 132. The transversely extending slot may, for example, be about one-half an inch in width. An angle bar 146 provided with a mounting slot in at least one of its ends is adaptable for use with retensioning screen frames 140 that employ transversely-oriented, distal, end-retensioning rollers 122, which tend to vary slightly in length from one screen frame to the next. By employing at least one transverse mounting slot 140, the angle bar 146 may be utilized with retensioning frames 140 that vary slightly in size in this manner.

Like the angle bar 46, the distal end angle bar 146 is provided with a pair of registration openings 54 in its radially projecting leg 150. The openings 154 are located at the same, uniform, fixed, lateral, registration element separation distance as the registration pins 44. That is, the registration openings 54 in the leg 150 of rigid angle bar 146 are located 4.25 inches apart, in the preferred embodiment of the invention.

The registration system of the embodiment of FIGS. 4 and 5 functions the same as the registration system of the invention illustrated in FIG. 1–3. That is, the retensionable screen frame 140 may be held at its proximal end by the clamping mechanism 38 depicted in FIG. 1. The retensionable screen frame 140 is thereby movably downwardly to a lowered position at which it resides in a horizontal disposition directly above the platen 12, as depicted in FIG. 5. In this position the registration pins 44 that project upwardly from the distal end 42 of the platen 12 enter the registration apertures 54 in the transverse angle bar 146, thereby ensuring precise, consistent alignment of the retensioning screen frame 140 relative to the platen 12. When the mounting arm 34 carrying the retensionable screen frame 140 is rotated upwardly, the angle leg 150 is lifted clear of the registration pins 44 so that the turntable 26 can be rotated ninety degrees to bring the screen frame 140 into angular registration with the next platen 12 in sequence.

Numerous other variations and modifications to for the registration system of the invention are also possible. The end angle piece 146 may, for example be constructed in lengths of 17.500, 17.750, and 19.750 inches in order to fit onto the distal ends of the most widely commercially utilized retensionable frames 140. In angle pieces 146 of these lengths, the registration openings 54 are respectively located 6.625 inches, 6.750 inches, and 7.750 inches from each of the opposite ends of the angle piece 146. Also, the sizes of the registration openings may vary as well. For example, the registration openings 54 may be larger or smaller to accommodate registration pins 44 of different diameters. Accordingly, the scope of the invention should not be construed as limited to the specific embodiments illustrated and described.

We claim:

1. In a screen printing apparatus employing a horizontally disposed platen for supporting material to be printed, a printing screen frame, a frame mounting arm having opposing ends and which holds said screen frame at one of said ends of said arm, and said arm is hinged for rotation about a horizontal axis at the other of its ends so as to alternatively carry said screen frame downwardly into a lowered position at which is resides in a horizontal disposition directly above said platen and to carry said screen frame upwardly to a raised position removed from said platen, and said screen frame and said platen thereby both have proximal ends located closest to said horizontal axis and distal ends located further from said horizontal axis than said proximal ends, the improvement comprising a first pair of laterally spaced registration elements positioned at fixed locations on said distal end of said platen and separated from each other by a predetermined, fixed, lateral, registration element separation distance and spaced from said horizontal axis a predetermined, fixed, radial, registration element placement distance, and a second pair of laterally spaced registration elements at fixed locations on said distal end of said screen frame separated from each other by said predetermined, fixed, lateral, registration element separation distance and both spaced from said horizontal axis by said predetermined, fixed, radial, registration element placement distance, and said first and second pairs of registration elements engage each other to ensure consistent alignment of said screen frame above said platen when said screen frame is in said lowered position, wherein said first pair of registration elements is formed as a pair of pins oriented perpendicular to said platen and further comprising a rigid member oriented transversely at said distal end of said screen frame and having a first leg permanently anchored by fasteners to said distal end of said frame and a second leg extending radially from said first leg, and wherein said second pair of registration elements is comprised of a pair of apertures extending through said second leg of said rigid member.

2. A screen printing apparatus according to claim 1 wherein said screen frame is a retensioning frame having a pair of parallel, side-stretching rollers and at least a distal, end-stretching roller oriented perpendicular to said side-stretching rollers, and said side-stretching rollers are joined to said distal, end-stretching roller by distal, corner-connecting angles, and said first leg of said rigid member is attached to said screen frame at said corner-connecting angles.

3. A screen printing apparatus according to claim 2 wherein said predetermined, fixed, lateral, registration element separation distance is at least four inches.

4. A screen printing apparatus according to claim 1 wherein said platen is comprised of a broad body and is formed with a neck considerably narrower than said body and projecting radially therefrom and said neck is at least about five inches long and forms said distal end of said platen.

5. A screen printing device comprising:

a base, at least one flat platen secured in a horizontal disposition to said base and having a proximal end closest to said base and a distal end furthest from said base, a screen mounting arm having a hinged end and a free end, an axle that joins said hinged end of said screen mounting arm to said base for rotation about a horizontal axis, whereby said screen mounting arm is rotatable relative to said base in a vertical plane passing through said platen, a screen frame having a proximal end held by said free end of said mounting arm and a distal end located remote from said axle, whereby rotation of said mounting arm alternatively carries said screen frame into a lowered position in which said screen frame is horizontally oriented and disposed directly above said platen and a raised position removed from said platen, a first pair of registration elements formed as a pair of pins projecting upwardly from said platen fixed at permanent locations on said distal end of said platen and separated from each other by a predetermined, fixed, lateral, registration element separation distance, an elongated, rigid member disposed transversely across said screen frame at said distal end thereof and formed with mutually perpendicular elements, one of which is anchored by fasteners to said distal end of said screen frame, and a second pair of registration elements formed as apertures in the other of said elements of said rigid member at said fixed, lateral, registration element separation distance, whereby said first and second pairs of registration elements are engageable with each other when said screen frame is in said lowered position, thereby ensuring consistent alignment of said screen frame in said lowered position relative to said platen.

6. A screen printing device according to claim 5 wherein said screen frame is comprised of retensioning rollers secured together with distal, end corner connectors, and said elongated, rigid member is secured to said screen frame at said distal, end corner connectors.

7. A screen printing device according to claim 5 wherein said fixed, lateral, registration element separation distance is at least about four inches.

8. A screen printing device according to claim 7 wherein said proximal end of said platen is formed as a broad, expansive body and said distal end of said platen is formed as a neck narrower than said body and extending from said body at least about five inches.

9. In a screen printing apparatus employing a base upon which a flat platen is secured in a horizontal orientation with a proximal end located closest to said base and a distal end located furthest from said base, a screen mounting arm having a hinged end attached to said base by a horizontal axle and an opposite, free end and rotatable relative to said base in a vertical plane passing through said platen, a screen frame comprising a proximal end held by said free end of said mounting arm and an opposite distal end, a pair of mutually parallel, laterally separated, radially extending stretching rollers, and at least one transverse stretching roller located at said distal end of said screen frame, and oriented perpendicular to said pair of radially extending stretching rollers, and distal, corner connectors joining said transverse stretching roller to said radially extending stretching rollers, the improvement comprising: a first pair of registration elements permanently fixed on said distal end of said platen and separated from each other by a predetermined, fixed, lateral, registration element separation distance, a rigid, transverse frame cross connector anchored to said distal corner connectors with fasteners and located radially beyond said transverse stretching roller and carrying a second pair of registration elements permanently fixed on said transverse frame cross connector at said fixed, lateral, registration element separation distance, and engageable with said first pair of registration elements when said free end of said screen mounting arm is rotated toward said platen by bringing said screen frame into vertical registration with said platen wherein one of said pairs of registration elements is comprised of a pair of mutually parallel pins and the other of said pairs of registration elements is comprised of a pair of apertures that receive said pins therewithin.

* * * * *